United States Patent [19]

Tuskos

[11] 4,231,157

[45] Nov. 4, 1980

[54] DRAPERY CLAMPING DEVICE

[76] Inventor: Michael E. Tuskos, 5719 W. Highway 22, Crestwood, Ky. 40014

[21] Appl. No.: 55,030

[22] Filed: Jul. 5, 1979

[51] Int. Cl.[3] ..... B43L 13/00

[52] U.S. Cl. ..... 33/18 R; 223/1.1; 38/104; 83/614

[58] Field of Search ..... 33/18 R; 223/1.1; 38/104; 83/614; 30/124

[56] References Cited

U.S. PATENT DOCUMENTS

| | | | |
|---|---|---|---|
| 3,738,007 | 6/1973 | Tuskos | 33/18 R |
| 3,858,475 | 1/1975 | Thater | 83/614 X |
| 4,027,394 | 6/1977 | Morantz | 33/18 R |

*Primary Examiner*—Harry N. Haroian
*Attorney, Agent, or Firm*—Edward M. Steutermann

[57] ABSTRACT

The present invention discloses a new and useful clamping arrangement for use in an upstanding drapery manufacturing device including frame means; a vertically adjustable trolley means; reference means defining a horizontal reference plane adjacent the lower end of the frame means and carriage means upon which are mounted marker means and cutter means for horizontal movement with respect to the upstanding frame along the reference means.

The improvement provided by the present invention comprises combining with such present device an elongate clamping means located adjacent the lower end of the frame to secure the lower end of a length of fabric as it is being marked and/or cut. The clamping means provided includes an elongate clamping base secured to a transverse support member adjacent the lower end of the frame, an elongate clamping bracket pivotably connected to the clamping base to close on a clamping bar to secure the lower portion of a length of fabric. An actuator means is provided to operate the elongate clamping bracket and cause it to move to its first and second positions. In the first position the clamping bracket holds the fabric securely against the clamping bar where the marker and cutter means can mark and cut the fabric along predetermined horizontal lines.

The invention can further be provided with a spring means attached to the clamping base and clamping bracket to hold the clamping bracket in its first or second position when manually operated.

12 Claims, 8 Drawing Figures

DRAPERY CLAMPING DEVICE

BACKGROUND OF THE INVENTION

The present invention relates to devices for manufacturing draperies and, more particularly, to a device which enables the drapery to be firmly held at the lower end of the upstanding drapery frame while the drapery is cut across the bottom of the panel.

The present invention more particularly relates to improvement of a device such as that described in detail in U.S. Pat. No. 3,439,438,—Tuskos, issued Apr. 22, 1969 and U.S. Pat. No. 3,738,007—Tuskos, issued June 12, 1973.

Heretofore, certain drapery manufacturing devices have been provided with a cutting means attached to an upstanding drapery device. Although such devices are a vast improvement over prior art such as tabling, where drapery panels were measured and cut on large tables, the present invention greatly improves the cutting technique now existing in the upstanding frame drapery devices.

Such prior upstanding drapery cutting devices have certain disadvantages in that the drapery or curtain is still susceptible to moving by a pushing motion for example the movement of the cutting means which causes the drapery to gather while the adjustable cutter means and marker means are moving along the horizontal carriage means at the lower end of the upstanding drapery device. Said movements while the drapery or curtain is being cut and marked creates an uneven hem line and bottom edge along the bottom of the drapery panel. The leading edge of the drapery is thereby cut or marked longer than required while the trailing edge of the drapery is cut and marked accurately. When the drapery is folded back along the hem line an uneven hem line is created which is unattractive and may even cause excessive wearing of the drapery or curtain if the drapery or curtain has areas that hang on the floor. The uneven bottom edge which is folded back and sewed may be unattractive where the drapery or curtain is of a material wherein light may be seen through it.

SUMMARY OF THE INVENTION

The present invention provides a method for cutting drapery fabric or curtains utilizing an upstanding frame device without the disadvantages of prior arrangements.

The improved arrangement provided by the present invention is particularly advantageous over previous devices including U.S. Pat. No. 3,738,000—Tuskos in that the present invention holds the entire lower edge of the fabric as the cutter and marker means mounted on a carriage means transverses the fabric in a horizontal path along the lower end of the upstanding frame. In previous arrangements the fabric was caused to gather by a pushing motion created by the cutter means transversing the fabric in a horizontal path. The present invention eliminates this problem by clamping the entire lower end of the fabric to the clamping bar thereby preventing the fabric from gathering as the cutter means cut the lower edge of the fabric as it moves along its horizontal path.

Additionally, the improved arrangement provides for the drapery fabric to include a slight angle of inclination which further assists in cutting the fabric. In this arrangement, the top edge of the fabric is secured by a fastener means to the top of the trolley. An angle of inclination is defined, as the fabric hangs down, between the vertical plane defined by the trolley and the plane defined by the fabric. This angle is created by the fabric hanging down over the reference means and clamping bar which are located on the outside of the vertical frame members while the trolley is within the plane defined by the vertical frame members. This slight angle of inclination enables the clamping bracket to clamp the fabric to the clamping bar better, holding the fabric taut while the cutter means cuts the fabric on a predetermined horizontal line. This improved arrangement provides for the fabric to be cut evenly at the desired length by securely fastening the lower edge of the fabric preventing the fabric from gathering or otherwise moving while the fabric is being cut.

The present invention provides improvement in a drapery manufacturing device of the type including an upstanding frame having first and second spaced, vertical plane defining, parallel guide tracks; with a vertically adjustable trolley means including a transverse member adapted to carry fastener means to move the trolley vertically with respect to the frame; reference means defining a horizontal reference plane adjacent the lower end of the frame; cutter means and marker means located adjacent the lower end of the frame for horizontal movement along a carriage means with respect to the frame. The improvement provided by the present invention comprises combining with such a device an elongate clamping means located adjacent the lower end of the frame to secure the fabric as it is being marked and/or cut.

Briefly, the present invention includes an elongate clamping base, pivotably secured to a transverse support member adjacent the lower end of the upstanding frame where an elongate clamping bracket closes on a clamping bar by pivoting the elongate clamping bracket provided to connect to the elongate clamping base at two pivotable points; and an actuator means to operate the elongate clamping bracket.

Additionally, a spring may be provided which attaches at one end to the elongate clamping base and at the opposite end to the elongate clamping bracket. The spring holds the clamping bracket in a first and second position so the clamping means may be manually operated.

It will be understood that various other arrangements within the scope of the present invention will occur to those skilled in the art upon reading the disclosure set forth hereinafter. For example, the elongate clamping means may consist of a simple clamping device or several clamping devices located at the bottom of the upstanding frame.

BRIEF DESCRIPTION OF THE DRAWING

The present invention is illustrated in the accompanying drawings wherein.

Figure 1:
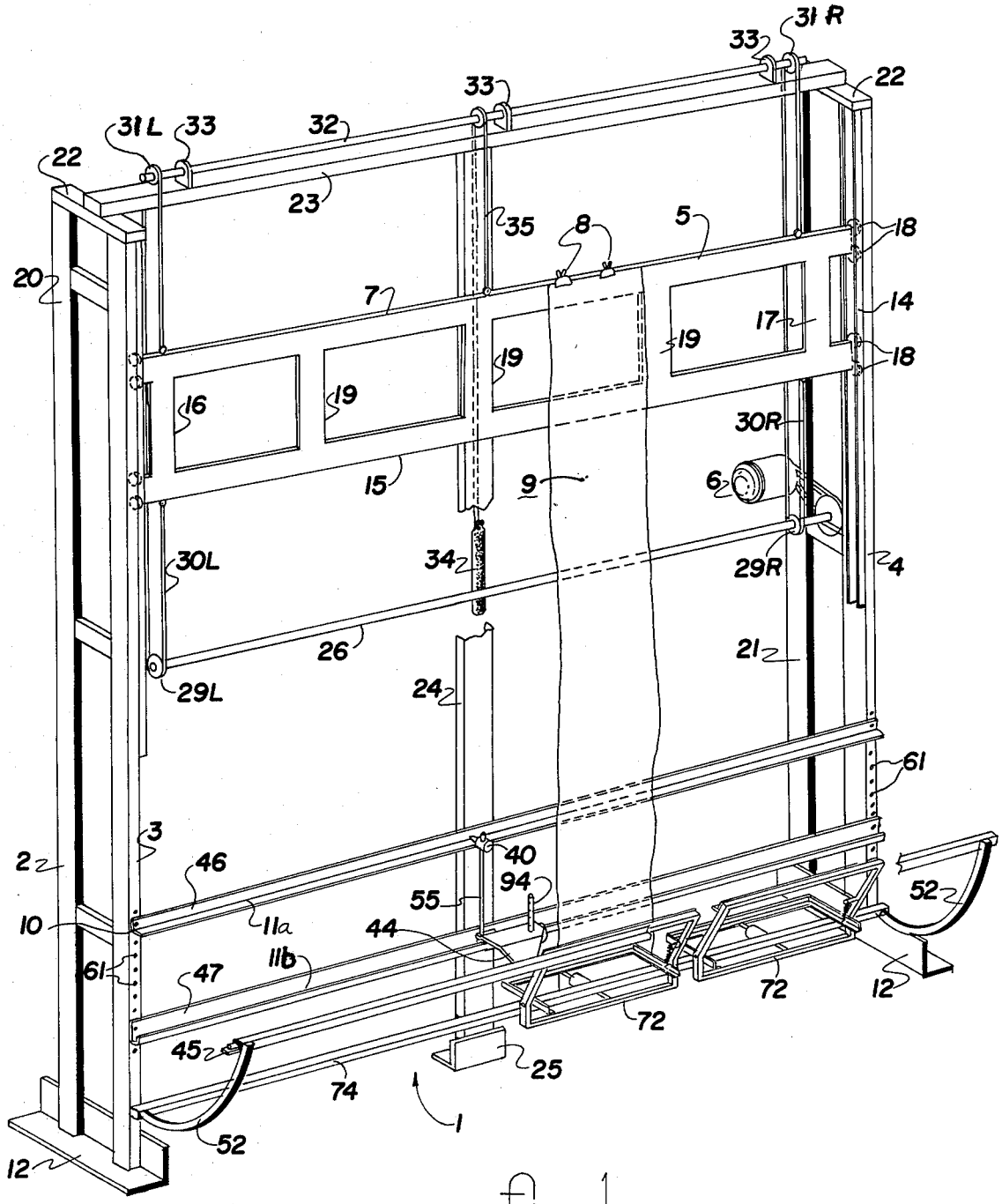
FIG. 1 is a perspective view of an improved upstanding drapery manufacturing device that is provided in accordance with the present invention.

Referring now to the drawings and particularly to FIG. 1 thereof, there is illustrated an improved device 1 that is provided in accordance with the present invention for manufacturing draperies and the like. It should be understood that the device 1 could obviously be utilized for other purposes, such as curtain manufacturing; but, the description that follows will be confined to drapes for the sake of clarity and brevity.

The improved device 1 shown in FIG. 1 in accordance with the present invention is an improved form of a device such as that described in detail in U.S. Pat. No. 3,738,000—Tuskos. Similarly, the present device includes an upstanding frame 2 having first and second spaced, vertical planes defining parallel guide track mounting members 3 and 4 and an adjustable trolley 5 which transversely spans the space between the vertical frame members 3 and 4 and is movably connected thereto for vertical movement with respect to the frame 2 by electrically powered drive means 6. The trolley 5 is generally rectangular in shape and is comprised of at least one transverse member 7, such as that forming its upper edge, which is provided with fastener means, such as a series of spring clamps 8, to grasp a length of fabric 9 to be formed into a drapery and vertically position the lower end of the fabric 9 with respect to the reference means 10 defining a pair of vertically spaced horizontal reference planes 11*a* and 11*b* adjacent the lower end of the frame 2.

The vertical frame members 3 and 4 are spaced apart by a distance great enough to accommodate the widest fabric 9 to be operated upon. In accordance with the improvement provided by the present invention, these vertical frame members 3 and 4 are supported by an iron base member 12 of the frame 2 and need not be fixed to a shop wall.

Vertical tracks are provided for the trolley 5 by respectively fixing a pair of channel shaped members (only 14 is visible in FIG. 1) to the vertical frame members 3 and 4 as by welding or other suitable fastening means, to extend downwardly from the tops thereof. The generally rectangular shaped trolley 5 is vertically arranged on the front of the frame 2 and preferably includes a second transverse member 15 which is spaced apart and parallel from the other transverse member 7 and thus forms its lower edge. The two transverse members 7 and 15 and the trolley 5 are interconnected by a pair of side members 16 and 17 that respectively form its left and right edges. Each of these side members 16 and 17 of the trolley 5 is provided with rollers 18 that are engaged in the vertical tracks respectfully provided for the members 16 and 17. Additional vertical support members 19 can be provided to the trolley 5.

Further in accordance with the present invention, the frame 2 is provided with an additional pair of vertical members 20 and 21, that are respectively spaced behind them and in alignment with the two trolley track vertical members 3 and 4. Each of these two rear vertical frame members 20 and 21, has its lower end supported by the frame base members 12 and has its upper end connected to the vertical member 3 or 4 immediately in front of it by horizontal frame member 22 that extends fore and aft of the device 1. The fore and aft top members 22 are interconnected by another horizontal top member 23 which extends transversely between them. Yet another vertical frame member 24 is provided that is centrally located between the two rear vertical members 20 and 21, and has its lower end supported by frame base member 25 and its upper end connected to the transverse top frame member 23.

As further shown in FIG. 1, the drive means 6 for the trolley 5 provides the components and functions similarly to that described in U.S. Pat. No. 3,738,000—Tuskos. The trolley drive shaft 26 extends horizontally between the left and right vertical frame members 3 and 4 and is rotatably journaled and connected thereto by bearing blocks (not shown) that are mounted on another pair of horizontal frame members (one of which 27 is visable in FIG. 1) that extend fore and aft between the two pairs of front and rear frame members. The trolley drive shaft 26 is provided with sprockets 29L and 29R adjacent its opposite left and right hands, and these sprockets 29L and 29R are respectively connected by left and right trolley drive chains 30L and 30R to other sprockets 31L and 31R that are provided on the opposite left and right hand of the drive shaft 32. The driven trolley shaft 32 extends across the top of the frame 2 and is rotatably journaled in additional bearing blocks 33 that are fastened to the transverse top frame member 23. One end of the two trolley drive chains 30L and 30R is respectively connected to the left of the frame 2 and is rotatably journaled in additional bearing blocks 33 that are fastened to the transverse top frame member 23. One end of the two trolley drive chains 30L and 30R is respectively connected to the left or right bottom corner of the trolley 5, while the opposite end of each of the chains 30L and 30R is respectively connected to the left or right top corner of the trolley 5.

Depending on the rotation of the motor output shaft (not shown) rotation in a first direction will cause the trolley 5 to move upward while rotation in the opposite direction will cause downward movement of the trolley 5. Upward movement of the trolley 5 is assisted by a counterweight 34 shown in FIG. 1 that is connected to the center of its upper transverse trolley member 7 by a cable 35 which is draped over pulley 36 that is connected centrally on the drive shaft 32. In accordance with U.S. Pat. No. 3,738,000—Tuskos, the device is provided with control means and limit switches (not shown) for controlling movement of the trolley 5.

Figure 2:
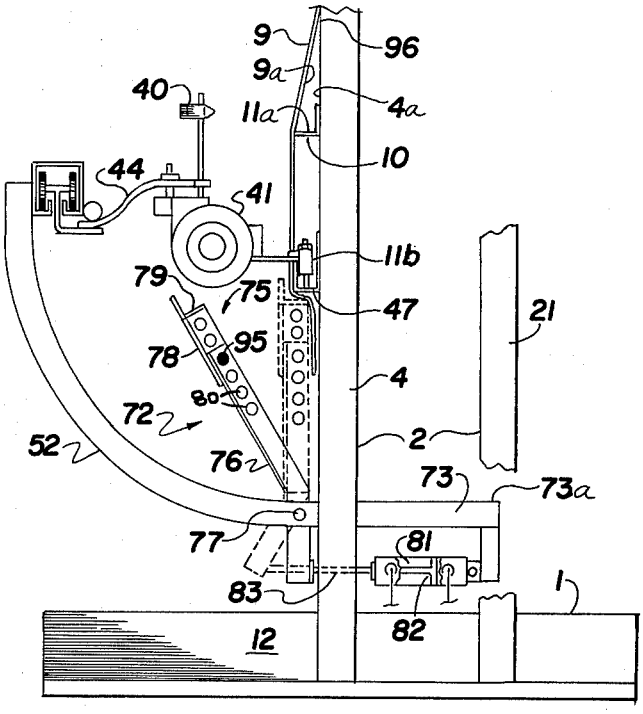
FIG. 2 is an enlarged partially broken, fragmentary right hand elevational view of the device shown in FIG. 1.
Figure 3:
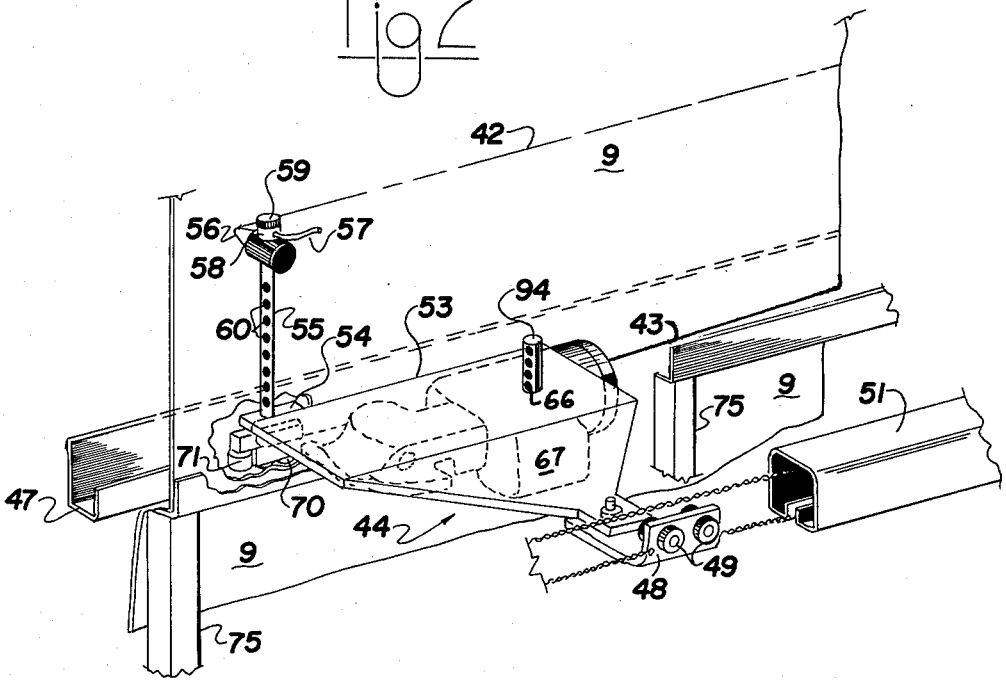
FIG. 3 is an enlarged, partially broken, fragmentary perspective view of a clamping means and carriage means provided in accordance with the present invention at the lower end of the device frame for horizontal movement relative thereto and of marker and cutter means carried thereby.

As shown in FIGS. 1, 2 and 3 the reference means 10 defines a pair of vertically spaced horizontal reference planes 11*a* and 11*b* adjacent the lower end of the frame 2 of the device 1, with respect to which the lower end of the fabric 9 is vertically positioned by attaching the fabric's upper end to the top of the trolley 5 by fastener means such as spring clamps 8. Marker means 40 and cutting means 41 are combined with the device 1 for respective movement relative to these two horizontal reference planes 11*a* and 11*b* to simultaneously mark the horizontal hem line 42 on the fabric 9 which is aligned with the first or upper of these two reference planes 11*a* and to simultaneously cut the lower edge of the fabric 9 along a cut 43 that is aligned with the second or lower of the two reference planes 11*b*.

As illustrated in FIGS. 1, 2 and 3 the new cutter means 41 and the marker means 40 are both mounted on a carriage means 44 which is driven by an electrically powered drive means 45 for horizontal movement relative to reference means 10 at the lower end of its frame 2 across the space between the vertical frame members 3 and 4 for simultaneously trimming the panel's lower edge with the cutter means 41 along the cut 43 while the hemline 42 is being marked thereon by the marker means 40. Furthermore, the device 1 is also preferably provided with control means, including toggle switches and limit switches (not shown) for automatically de-energizing the carriage means 44 upon completion of each traverse of the space between the vertical frame members 3 and 4 by the carriage means 44. The horizontal reference plane 11*a* and 11*b* that are provided by the reference means 10 are comprised of an angle iron 46 and a clamping bar 47 which are vertically spaced apart from one another and horizontally connected to the lower front side of the left and right front vertical frame members 3 and 4. The clamping bar 47 consists of a "J" shaped channel iron. The vertical space between these two horizontal reference planes 11*a* and 11*b* defines the length of the material of the fabric 9 that is utilized to form the hem at its lower end.

As shown in FIGS. 1 and 3 the carriage means 44 comprises a plate 67 having one of its ends 48 hooked upwardly and provided with rollers 49 horizontally journaled thereon. The rollers 49 are, in turn, mounted for rolling movement relative to the carriage track means 51 which is connected to and extends transversely between a pair of downwardly arched frame members 52 that are respectively connected to the bottoms of the left and right vertical frame members 3 and 4 and extend forwardly and upwardly therefrom to an elevation spaced between the two horizontal reference planes 11*a* and 11*b*. Additional arched frame members (not shown) can be provided for support as needed. The carriage means is automatically powered as previously described in U.S. Pat. No. 3,738,000—Tuskos.

As further shown in FIGS. 1 and 2 and more particularly in FIG. 3 the carriage plate 67 has another end 53 which extends generally horizontally rearwardly from its upwardly turned end 48 toward the reference means 10. The marker means 40 are connected to a bracket 54 mounted on the front of the carriage plate end 53 by an upright post 55 and preferably comprised of a compressed air operated nozzle 56 that is filled with the marking material of the type such that the hemline 42 that is marked on the fabric 9 thereby will be invisible unless viewed under ultraviolet lighting. The compressed air is supplied from the marking nozzle 56 from a compressed air source (not shown) through a compressed air line 57 that is connected to the marking nozzle 56 through a normally closed valve 58 that is operated by an electric solenoid 59.

Post 55 is provided with holes 60 in spaced relation thereto so that the marker means 40 is vertically adjustable. Similarly vertical frame members 3 and 4 are provided with cooperatively spaced holes 61 so that the angle iron 46 defining the reference plane 11*a* is similarly adjustable.

Figure 6:
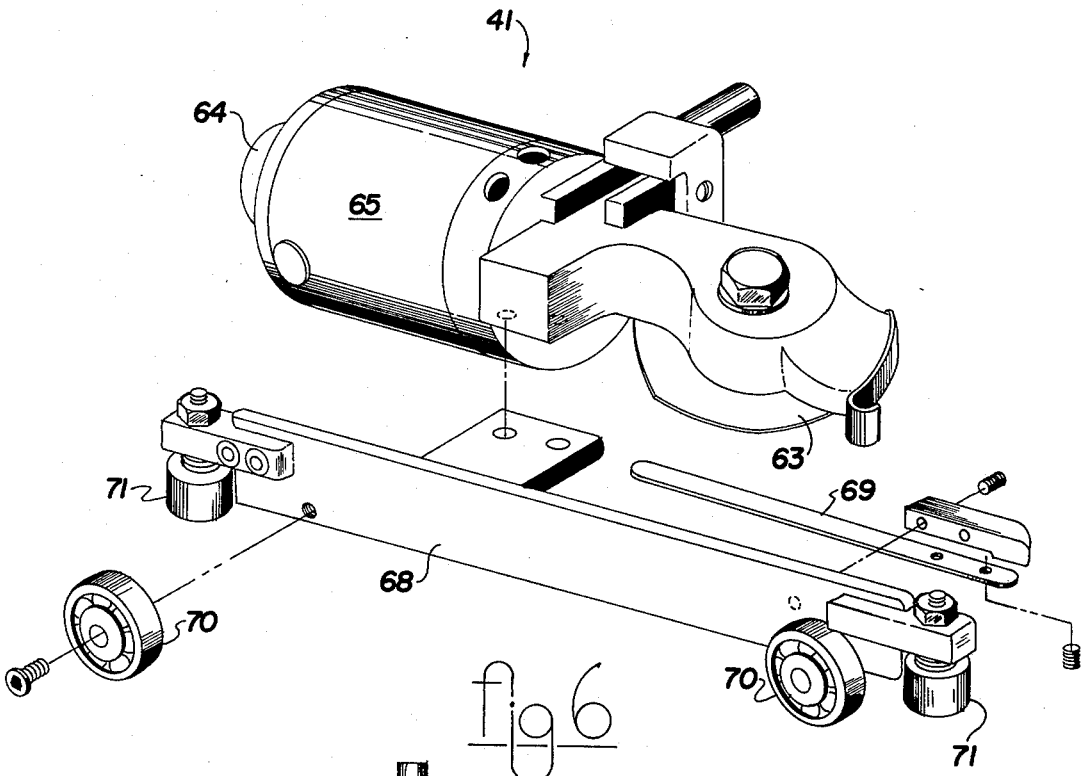
FIG. 6 is an enlarged, exploded, rear perspective view of the improved cutter means.
Figure 7:
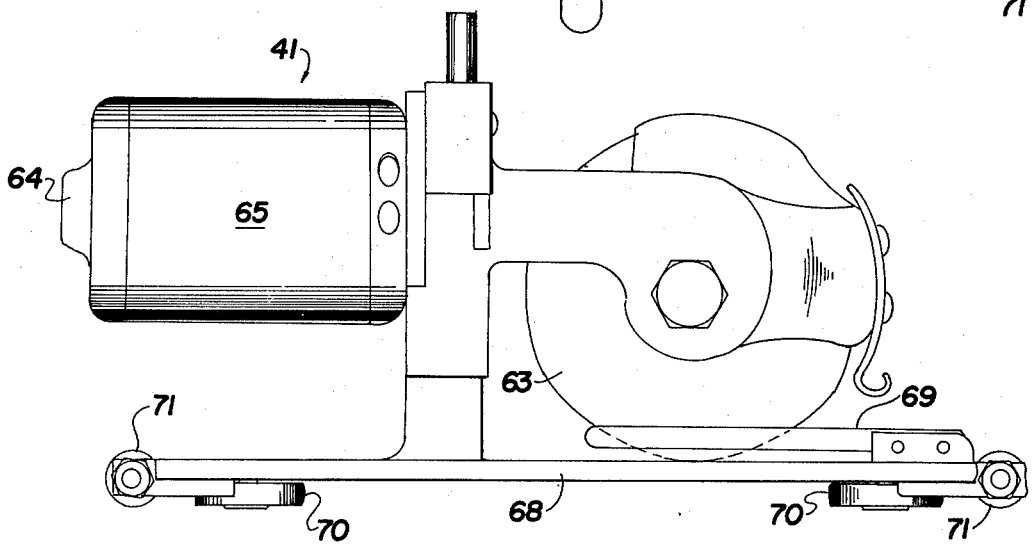
FIG. 7 is an enlarged top view of the improved cutter means.

As shown in detail in FIGS. 6, 7 and 3 the cutting means 41 comprises an electrically powered disc blade 63 which includes an electric motor 64 that is contained in housing 65 and is mounted on a post 94 which passes through a hole 66 on the top right hand side of the carriage plate 67 of the carriage means 44. The cutter means 41 further includes elongate plate means 68 on which two vertical rollers 70 and two horizontal rollers 71 are attached for a rolling movement relative to cutter means 41 as it transverses along the clamping bar 47 between the vertical frame members 3 and 4. The vertical rollers 70 are provided for movement in the "J" channel iron provided by the clamping bar 47. Additionally a stationary blade 69 is mounted on the elongate plate means 68 to assist the disc blade 63 in cutting the drapery fabric as the cutter means 41 moves horizontally along the carriage means 44.

As shown in FIG. 2 the clamping means 72 is located adjacent the lower end of the frame 2 to secure the lower end of the drapery fabric 9 as it is being cut or marked. The clamping means 72 includes an elongate clamping base 73 which defines a horizontal plane 73*a* and is attached to a transverse support member 74 (shown in FIG. 1) of the lower end of the frame 2. The clamping means 72 further includes a cooperative and pivotable clamping bracket 75 consisting of a base means 76, sliding means 78, and bracket clamping means 79. The base means 76 attaches to the elongate clamping base 73 at two pivotable points 77 (only one shown in FIG. 2), a sliding means 78 is attached to and adjustable in relation to the base means 76 and is fastened to the base means 76 by two bolts 95 (only one is shown in FIG. 2), and bracket clamping means 79 which can be an elongate angle iron fastened to the top of the sliding means 78 so that the angle formed opens upwardly and towards the upstanding frame. The sliding means 78 and the base means 76 of the clamping bracket 75 are provided with cooperative holes 80 in spaced relation to each other which allow the sliding means 78 of the clamping bracket 75 to be adjustable in relation to the base means 76 of the clamping bracket 75. Such adjustment provides for the proper clamping of the drapery fabric 9 when the clamping bar 47 is adjusted to provide for the cutting of fabric 9 of various hem lengths. The clamping means 72 further includes an actuator means 81 including a double acting cylinder 82 and an end rod 83 which connects to the base means 76 of the clamping bracket 75 and operates the clamping means.

Figure 4:
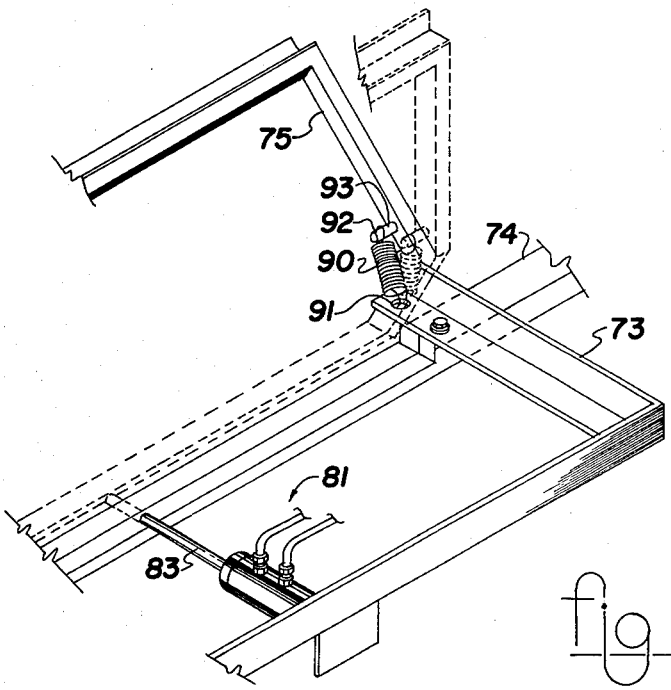
FIG. 4 is an enlarged, partially broken, fragmentary rear prospective view of the clamping means and spring means.
Figure 5B:
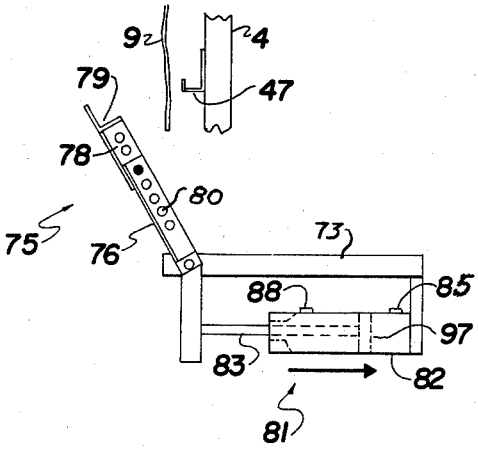
FIGS. 5*a* and 5*b* are enlarged, partially broken, fragmentary elevational views taken along line B—B in FIG. 4 showing the actuator means in its first and second positions respectively.
Figure 5A:
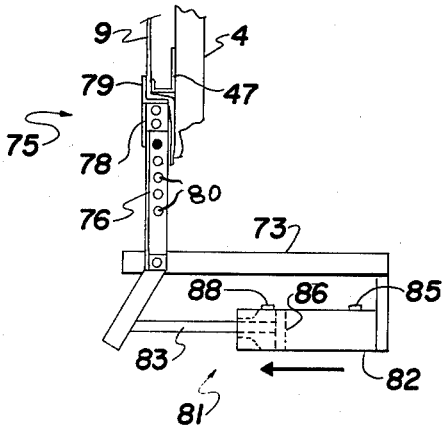

In operation as shown in FIGS. 2, 4 and in particular FIG. 5*a* the actuator means includes a signal (not shown), for example, a pressurized fluid such as air enters port 85 and moves the double acting cylinder 82 to a second position 86. This movement extends the rod 83 outwardly and causes the clamping bracket 75 to pivot from its original position to a second position (shown by dotted lines) where the clamping bracket 75 clamps the drapery fabric 9 between the clamping bar 47 and the bracket clamping means 79 fastened to the top of the clamping bracket 75. After the cutter means 41 has cut the drapery fabric 9 along the predetermined horizontal line, the clamping means may be released by a second signal.

As shown in FIG. 5*b* the actuator means 81 provides a second signal (not shown) which enters port 88 and moves the double acting cylinder 82 from its second position to its original or first position 97. This movement retracts the end rod 83 and causes the clamping bracket 75 to move away from the vertical plane defined by the upstanding frame 2 which releases the cut portion of the drapery fabric 9 and it falls into a drop box (not shown).

As shown in FIG. 4 a spring means 90 can be provided to attach to the clamping base 73 at a hole 91 provided and further attach to the clamping bracket 75 at a hole 92 in a post means 93 to hold the clamping bracket 75 in a first and second (shown by dotted lines in FIG. 4) position. Hole 91 is ideally positioned directly below the pivot point 77 so that when the clamping bracket is in the first and second positions the spring means is in a rest position. Only when the clamping bracket is in motion between its first and second position is the spring in higher tension. The spring means 90 is provided so that the clamping means 72 can be manually operated.

As shown in FIG. 2 an angle of inclination 96 is defined between the plane 4*a* defined by the vertical support member 4 and the plane 9*a* defined by the length of fabric 9. This slight angle of inclination 96 further enables the clamping bracket 75 to clamp the fabric 9 to the clamping bar 47 better, holding the fabric 9 taut while the cutter means cuts the fabric on a predetermined horizontal line.

The invention claimed is:

1. A drapery manufacturing device including: an upstanding frame having first and second generally parallel spaced, vertical plane defining guide tracks; horizontally disposed trolly means adapted for vertical movement on said guide means including a transverse member adapted to carry fastener means to secure one end of a length of fabric; drive means to move said trolley means vertically with respect to said frame; reference means defining a horizontal reference plane adjacent the lower end of said frame; carriage means mounted adjacent the lower end of said frame and mounted for horizontal movement in relation to said frame adjacent said reference means; marker means adapted to be carried by said carriage means; an improvement comprising: elongate clamping means located adjacent the lower end of said frame to secure the lower end of said fabric as it is being marked, including clamping base means adjacent the lower end of said frame, horizontally extending elongate clamping bar means located adjacent the lower end of said frame, elongate clamping bracket means pivotably connected to said clamping base means at two pivot points to pivot between a first position adjacent said frame to retain said fabric between said clamping bar means and said elongate clamping bracket means and a second position where said elongate clamping bracket means are disengaged from said clamping bar means to release said fabric; and actuator means to selectively operate said clamping bracket means between said first and second positions.

2. The invention of claim 1 wherein said marker means includes cutter means and said cutter means is adapted to be carried by said carriage means adapted for horizontal movement with respect said frame means.

3. The invention of claim 2, further including improved cutter means adapted to be carried by said carriage means and provided with rotary disc blade, stationary single blade, elongate plate means having vertical rollers and horizontal rollers for movement along and in said clamping bar means.

4. The invention of claim 3 further including adjustable post means to vertically adjust said cutter means in relation to said carriage means and said clamping bar means.

5. The invention of claim 1 where said elongate clamping bracket means includes a base means attached to said clamping base means at said pivot points, sliding means attached to and adjustable in relation to said base means, bracket clamping means comprising an elongate angle iron fastened to said sliding means, and cooperative holes in spaced relation to each other provided in said base means and said sliding means which provide for the adjustment of the clamping bracket means.

6. The invention of claim 1 where said clamping means can be manually operated.

7. The invention of claim 1 where said clamping means includes a spring means to hold said clamping bracket means in its said first or second position when manually operated.

8. The invention of claim 7 where said spring means is in higher tension when said clamping bracket means is between its said first or second position then when said clamping bracket means are in said first and second position.

9. The invention of claim 1 where said marker means are adjustable vertically in relation to said carriage means.

10. The invention of claim 1 where said reference means are adjustable vertically in relation to said frame and said marker means.

11. The invention of claim 1 wherein said clamping bar means are vertically adjustable in reference to said frame and said cutter means.

12. The invention of claim 1 wherein said transverse member and said clamping bar means are positioned so a selected angle of inclination is provided between the plane defining said trolley means and the plane defined by said length of fabric.

* * * * *